US008278556B2

(12) United States Patent
Waltz

(10) Patent No.: US 8,278,556 B2
(45) Date of Patent: Oct. 2, 2012

(54) STABILIZATION OF DIELECTRIC USED IN TRANSMISSION LINE STRUCTURES

(75) Inventor: Peter Michael Waltz, Exeter, NH (US)

(73) Assignee: Cobham Defense Electronic Systems Corporation, Bolton, MA (US)

( * ) Notice: Subject to any disclaimer, the term of this patent is extended or adjusted under 35 U.S.C. 154(b) by 1433 days.

(21) Appl. No.: 10/389,790

(22) Filed: Mar. 17, 2003

(65) Prior Publication Data

US 2004/0182598 A1 Sep. 23, 2004

(51) Int. Cl.
*H01B 5/02* (2006.01)

(52) U.S. Cl. ..... 174/126.3; 174/28

(58) Field of Classification Search ..... 174/126.3, 174/129 R, 133 R, 102 SP, 28
See application file for complete search history.

(56) References Cited

U.S. PATENT DOCUMENTS 290,769 A * 12/1883 Gray ..... 174/133 R
543,960 A * 8/1895 Gray ..... 174/133 R
4,280,016 A * 7/1981 Ege ..... 174/102 R
4,626,810 A * 12/1986 Nixon ..... 333/243
4,687,884 A * 8/1987 DeHart ..... 174/130
5,430,255 A * 7/1995 Downie et al. ..... 174/110 R
5,938,474 A * 8/1999 Nelson ..... 439/583
6,541,708 B2 * 4/2003 Suehiro ..... 174/126.3
2003/0178224 A1 * 9/2003 Goto ..... 174/133 R
2004/0168888 A1 * 9/2004 Brixius et al. ..... 198/575

* cited by examiner

*Primary Examiner* — Chau Nguyen
(74) *Attorney, Agent, or Firm* — Jaeckle, Fleischmann & Mugel, LLP

(57) ABSTRACT

Stabilization of dielectrics used in transmission lines is described. In one implementation, the transmission line includes an outer conductor, a center conductor, and a dielectric material. The dielectric material separates the outer conductor from the center conductor. The center conductor has a conductive surface with a pattern distributed thereon. The pattern is configured to prevent the dielectric material from moving when the transmission line is exposed to an extreme temperature fluctuation. The pattern increases a coefficient of friction between the center conductor and dielectric material sufficient enough to prevent undesired motion of the dielectric material. In one implementation, the pattern includes indentations that are generally, but not necessarily limited to between 0.001 and 0.004 of an inch deep.

20 Claims, 5 Drawing Sheets

Fig. 2A
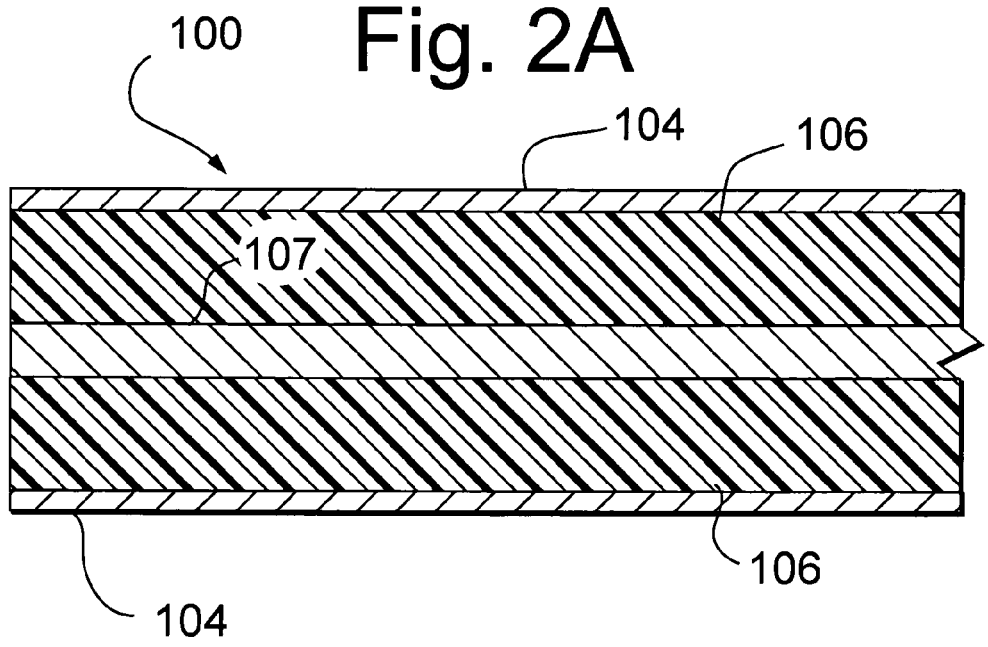
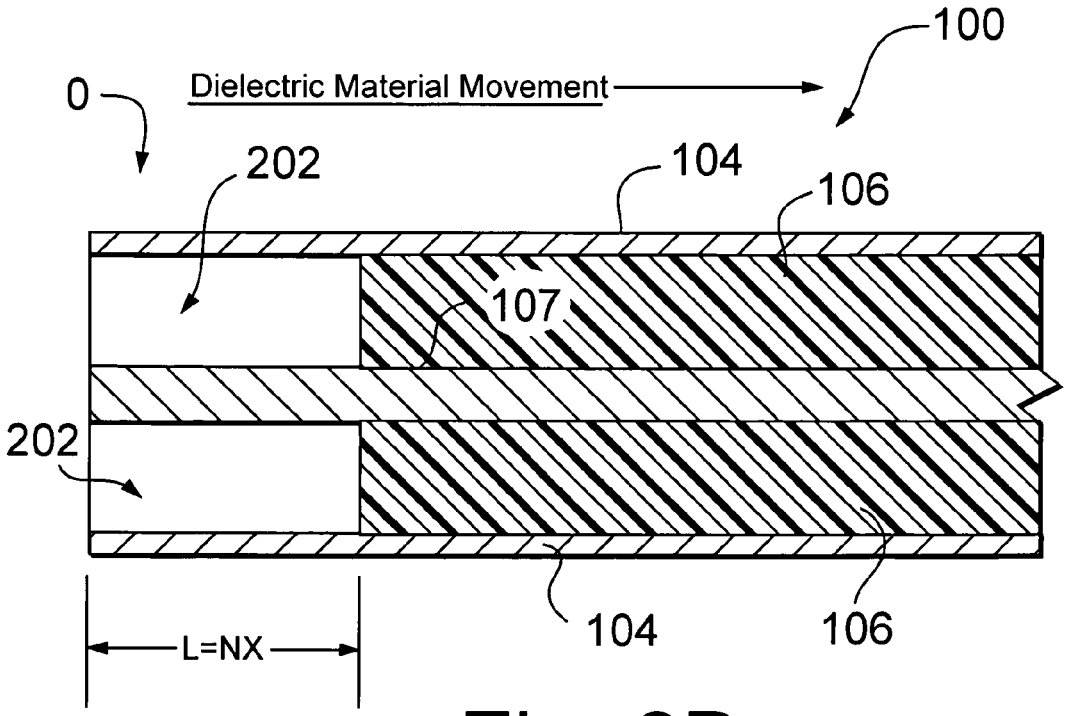
Fig. 2B

STABILIZATION OF DIELECTRIC USED IN TRANSMISSION LINE STRUCTURES

TECHNICAL FIELD

The present invention relates generally to transmission line structures used in aerospace applications.

BACKGROUND

Aerospace devices, such as satellites and high altitude airplanes are exposed to extreme temperature fluctuations. For example, it is common for a satellite in geo-stationary orbit to travel in and out of the earth's shadow once a day causing it to be exposed to temperature fluctuations ranging from below negative 54 degrees Fahrenheit while in the earth's shadow to between 200-to-300 degrees Fahrenheit when exposed to the sun.

Low loss transmission line structures are often used in aerospace applications to provide signal conductivity for various components used in such applications. These transmission line structures are stressed by the extreme temperature fluctuations described above. For example, a transmission line structure typically includes a dielectric that tends to expand and contract when exposed to heat and cold, respectively. Beside compressing and expanding, it is common for the dielectric to shift in a longitudinal direction along the axis of the transmission line. This motion of the dielectric eventually creates voids within the coaxial cable, which can lead to a short circuit or poor signal conductivity. Eventual catastrophic failure of the transmission line will occur from this undesired movement of the dielectric. Consequently, there is an increased possibility that an aerospace device or application may also experience some type of failure.

SUMMARY

Stabilization of dielectrics used in transmission lines is described. In one implementation, the transmission line includes an outer conductor, a center conductor, and a dielectric material. The dielectric material separates the outer conductor from the center conductor. The center conductor has a conductive surface with a pattern distributed thereon. The pattern is configured to prevent the dielectric material from moving when the transmission line is exposed to an extreme temperature fluctuation.

The following exemplary implementations, therefore, introduce the broad concept of using the center conductor to stabilize dielectric material used in transmission lines by placing at least one pattern on the conductive surface of the center conductor. The pattern increases a coefficient of friction between the center conductor and dielectric material sufficient enough to prevent undesired motion of the dielectric material. In one implementation, the pattern includes indentations that are between approximately 0.001 and 0.004 of an inch deep, although other dimensions, greater or smaller, may be possible.

BRIEF DESCRIPTION OF THE DRAWINGS

The detailed description is described with reference to the accompanying figures. In the figures, the left-most digit(s) of a reference number identifies the figure in which the reference number first appears. It should be noted that the figures are not drawn to scale and are for illustration purposes only.

FIGS. 2A and 2B show cross sectional views of transmission line structure 100 along the longitudinal axis, which is perpendicular to the cross sectional view shown in FIG. 1.

DETAILED DESCRIPTION

Figure 1:
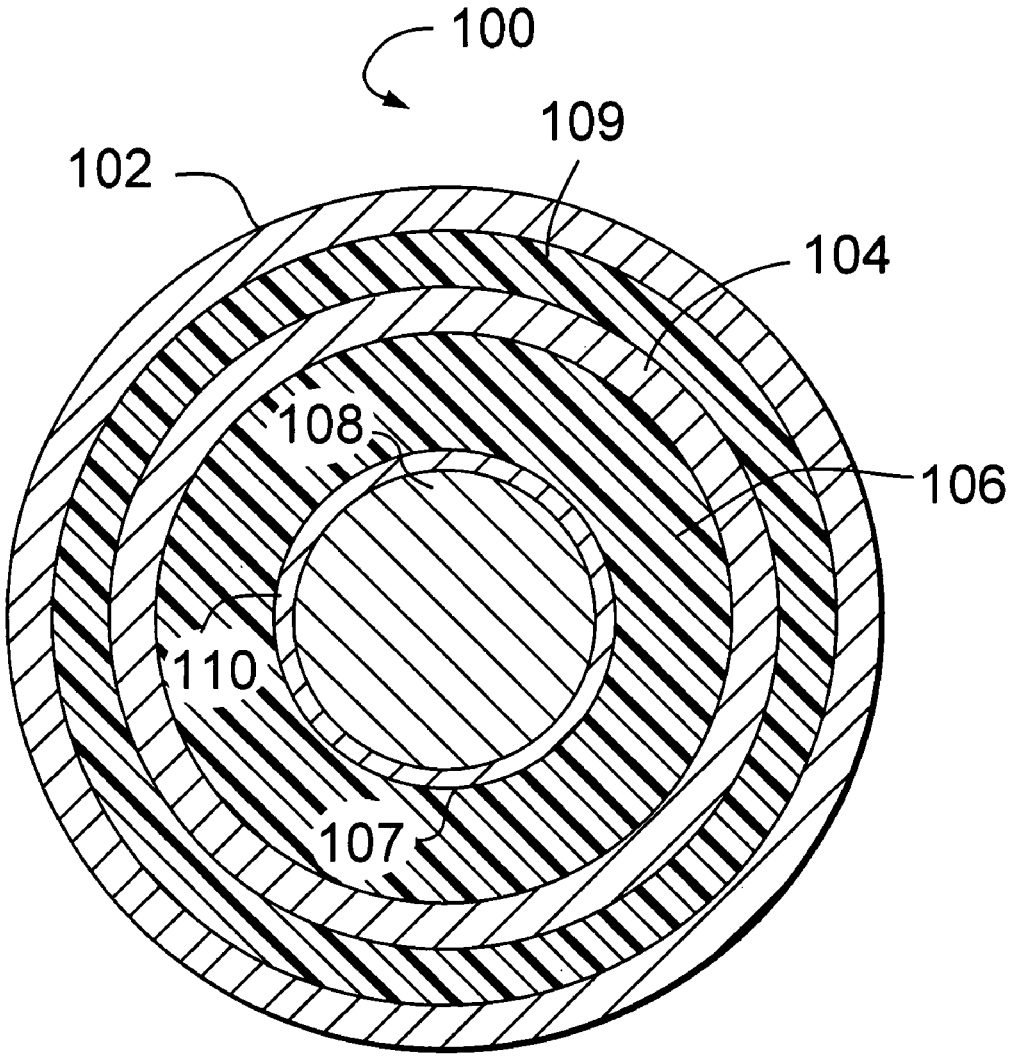
FIG. 1 is a cross-sectional view of a transmission line structure.

FIG. 1 is a cross-sectional view of a transmission line structure 100. Transmission line 100 is typically used in aerospace applications, such as satellites, rockets, and extremely high altitude airplanes. Accordingly, transmission line 100 may be exposed to extreme temperature fluctuations with temperature variations ranging from above 200 degrees Fahrenheit to below negative 50 degrees Fahrenheit.

According to an exemplary implementation, transmission line 100 may include a jacket 102, an outer conductor 104, a dielectric material 106, and a center conductor 107 having a conductive surface 110 and possibly a conductive core 108. Jacket 102 may be any flexible standard insulating material able to withstand extreme temperatures. Jacket 102 is commonly used to encase all elements of transmission line 100 and is usually some type of dielectric material such as Fluroninfied Ethylene Propylene (FEP), Perfluroroalkoxy (PFA), or Ethylene Tetra Fluroreethlylene (ETFE). Outer conductor 104 may be a conductive material such as copper or conductive materials typically used in low loss transmission line structures. In certain implementations, outer conductor 104 may include round wire braiding 109 in addition to outer conductor 104, which provides flexibility for the outer conductor 104.

Center conductor 107 typically includes a conductive core 108, which may be any type of flexible material, typically made of a conductive material such as copper. Other materials may also be selected for core 108, such as copper-clad steel. Typically, center conductor 107 includes a conductive surface 110 that is made of a highly conductive and very low loss material. For example, in the exemplary implementation, center conductor 107 is silver-plated copper, or in other words, conductive surface 110 is silver plating over a copper core 108. Other materials may be selected for conductive surface 110 such as gold.

In one implementation, center conductor 107 is approximately 0.087 inches in diameter with conductive surface 110 being 200 microinches thick. Depending on the application, other diameters and thicknesses, greater or smaller, may be selected for center conductor 108 and conductive surface 110, respectively.

It should be noted that there is generally a ratio of less than 1.06 when center conductor 107 is measured in an optical comparator with its conductive surface 110 represented in shadow. To obtain this ratio, one can measure the largest apparent diameter and the smallest apparent diameter of the center conductor 107, and then take the ratio of the largest measurement over the smallest measurement to arrive at the ratio.

Separating the center conductor 107 from outer conductor 104 is a dielectric material 106, which electrically insulates and encases the center conductor 107. The material selected for providing dielectric qualities should be flexible and able to withstand repetitive temperature fluctuations in the order of 350 degrees Fahrenheit or greater (i.e., −54° F. and below to +300° F. and above). In one implementation, dielectric material 106 includes one or more layers of polytetrafluoroethylene.

It is to be appreciated that additional components can be included in transmission line structure 100. For example, additional conductors, connectors, or dielectric materials may be included as part of transmission line structure 100.

As described above, it has been observed that dielectric material 106 shows undesirable movement from its original location when exposed to extreme temperature fluctuations. That is, dielectric material 106 will move in a particular direction: the long axis of transmission line structure 100. For example, FIGS. 2A and 2B show cross sectional views of transmission line structure 100 along the longitudinal axis, which is perpendicular to the cross sectional view shown in FIG. 1. In these views, only the outer conductor 104, dielectric 106, and center conductor 107 are shown for simplicity of illustration. FIG. 2A shows the original location of dielectric material 106 prior to being exposed to temperature fluctuation, whereas FIG. 2B shows the position of the dielectric material 106 after being exposed to many thermal cycles.

According to FIG. 2B, dielectric material 106 moves a distance X, each time the transmission line structure 100 is exposed to the type of extreme temperature fluctuations described above. Reference number 0 represents the original location of dielectric material 106. Eventually, a void 202 will form as the transmission line structure 100 moves in a particular direction when it is exposed to temperature fluctuations. In terms of distance, the void may be equal to approximately N*X, where N represents the number of times the transmission line structure 100 is exposed to extreme fluctuation, usually going from hot to cold. In some applications, the void 202 may grow on the order of inches, causing a significant void between conductors. The described implementations below are designed to prevent this undesired relative motion of dielectric material 106.

Figure 3:
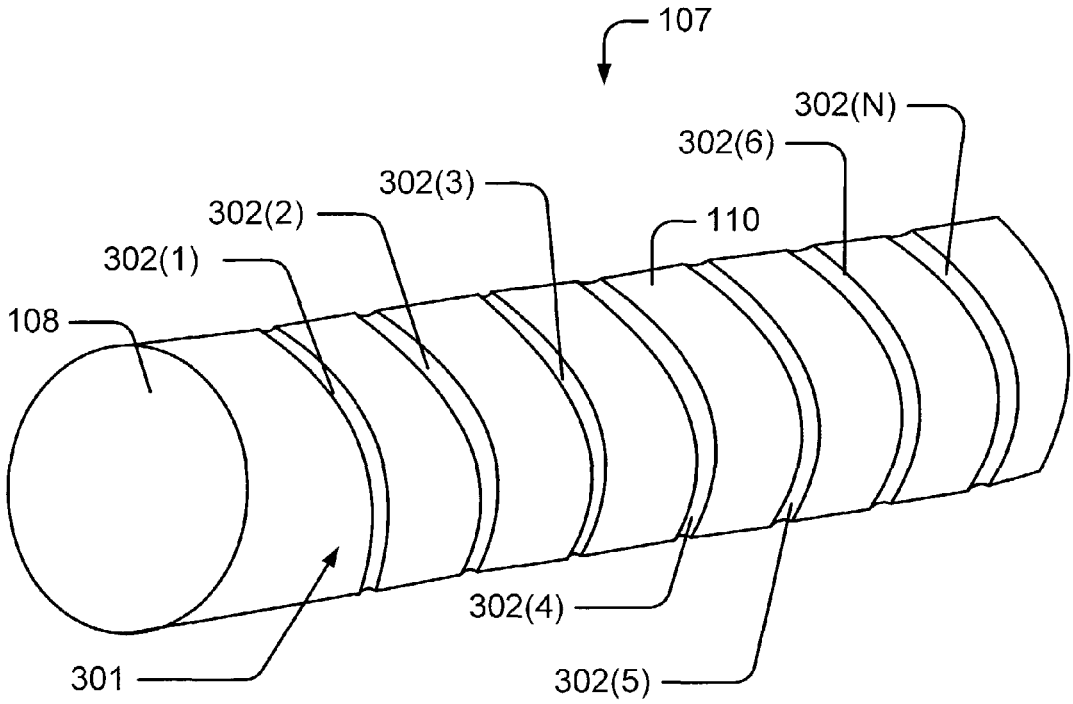
FIG. 3 shows a perspective view of a portion of a center conductor.

FIG. 3 shows a perspective view of a portion of center conductor 107. In this example, center conductor 107 has a pattern 301 distributed on the surface of the conductive surface 110. In particular, pattern 301 forms indentations 302(1), 302(2), 302(3), 302(4), 302(5), 302(6), . . . , 302(N) within the conductive surface 110. Each indentation referred to generally as reference number 302, may be a dent or scratch made in the conductive surface 110.

To avoid breaching the thin conductive layer 110, each indentation is made by a hard, smooth tool, which causes the material to flow, but does not penetrate through the plating. In one implementation, the pattern 301 includes indentations that are generally between 0.001 and 0.004 of an inch deep. Of course, the indentation depths may vary, greater or smaller, depending on the size of the center conductor.

Pattern 301 is configured to prevent dielectric material (shown as 106 in FIGS. 1 and 2) from moving when the transmission line is exposed to an extreme temperature fluctuation. For example, pattern 301 illustrated in FIG. 3 increases a coefficient of friction between the center conductor 107 and dielectric material 106 sufficient enough to prevent undesired motion (see FIG. 2) of the dielectric material 106. As illustrated in FIG. 3, pattern 301 specifically includes helical indentations 302 similar to threads of a screw, forming furrows in the surface of conductive surface 110. Each furrow is nearly transverse to the direction of the motion of the dielectric material 106.

Figure 4:
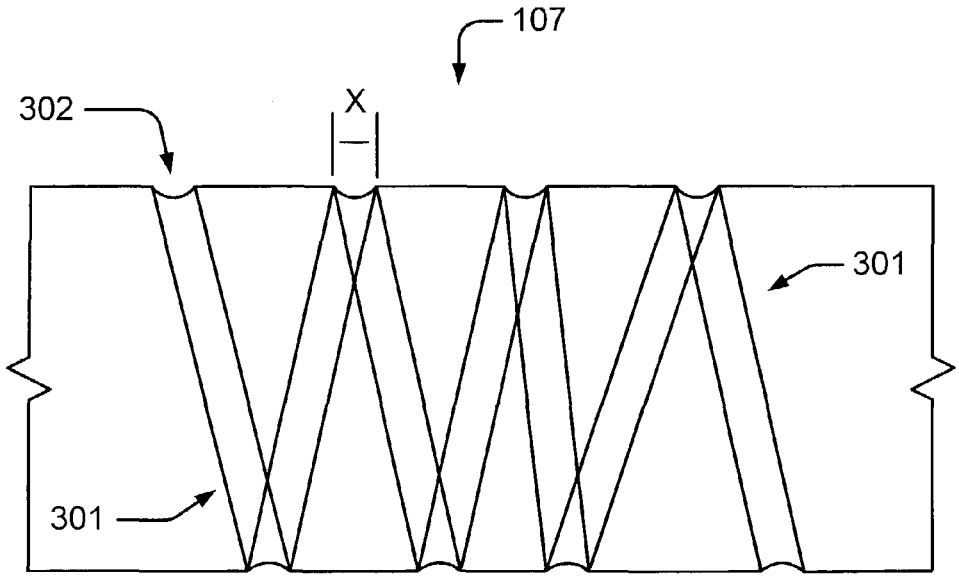
FIG. 4 shows a planar side view of the center conductor shown in FIG. 3.

FIG. 4 shows a planar view of the center conductor 107 shown in FIG. 3. Pattern 301 was made using a roll-threading tool designed to make 32 pitch threads. Each indentation 302 (also referred to as a thread or furrow) is in the form of a shallow indentation with a smooth radiused shape. Since material from the conductive surface is actually extruded in an outward direction from each indentation 302, it is possible for the major diameter of center conductor 107 to increase from the rolling process 302. For example, the total major diameter of center conductor 107 may increase to 0.089 inches from 0.087 inches from the rolling process. Each indentation in this exemplary illustration is approximately 0.006 inches wide, but other widths referred to generally as X may be selected that are greater or smaller.

Figure 5:
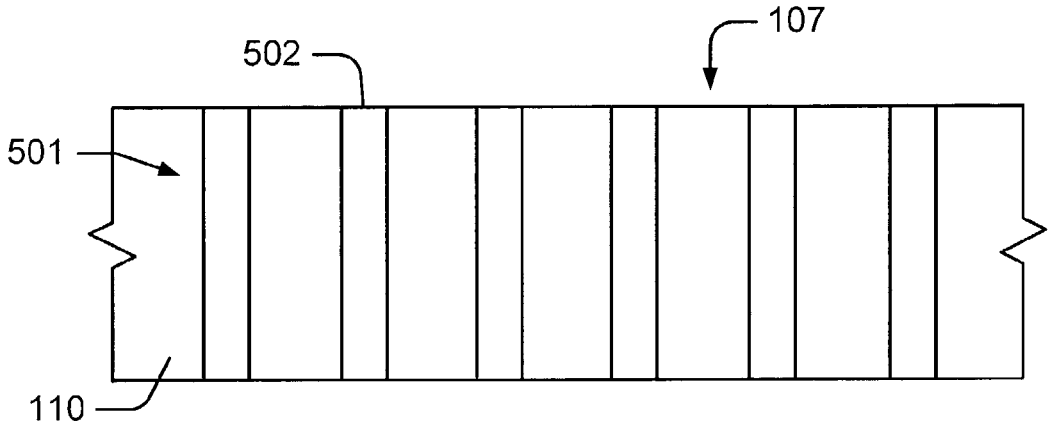
FIG. 5 shows a pattern with concentric indentations distributed on a conductive surface of a center conductor.
Figure 6:
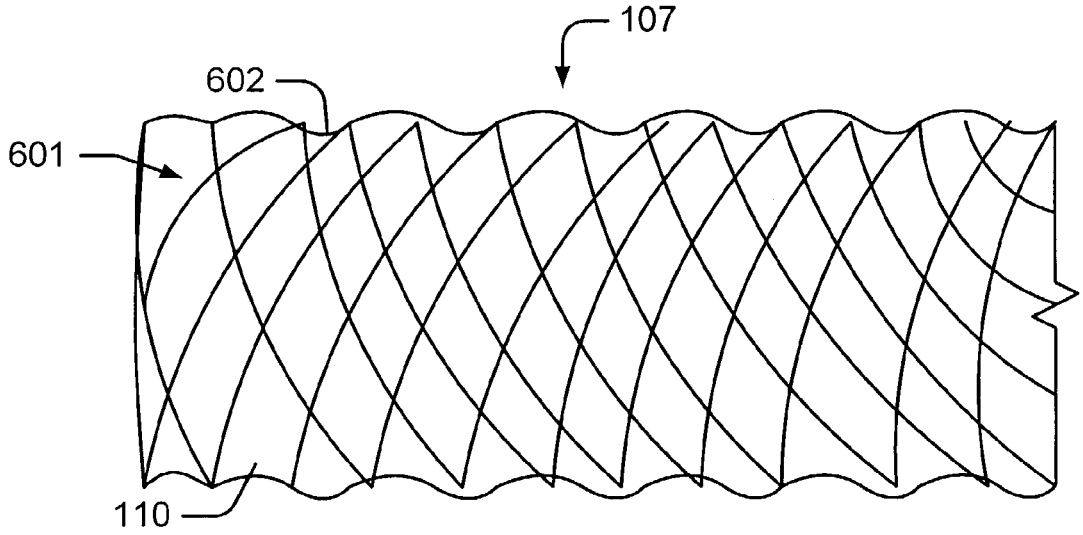
FIG. 6 shows a pattern with diamond knurl indentations distributed on a conductive surface of a center conductor.

Pattern 301 is not limited to helical indentations. In fact, just about any pattern may be selected for distribution on conductive surface 110. For instance, FIG. 5 shows a pattern 501 with concentric indentations 502 (furrows that do not connect) distributed on conductive surface 110 of center conductor 107. FIG. 6 shows a pattern 601 with diamond knurl indentations 602 distributed on conductive surface 110 of center conductor 107. This pattern could also be some type of helical knurl.

Figure 7:
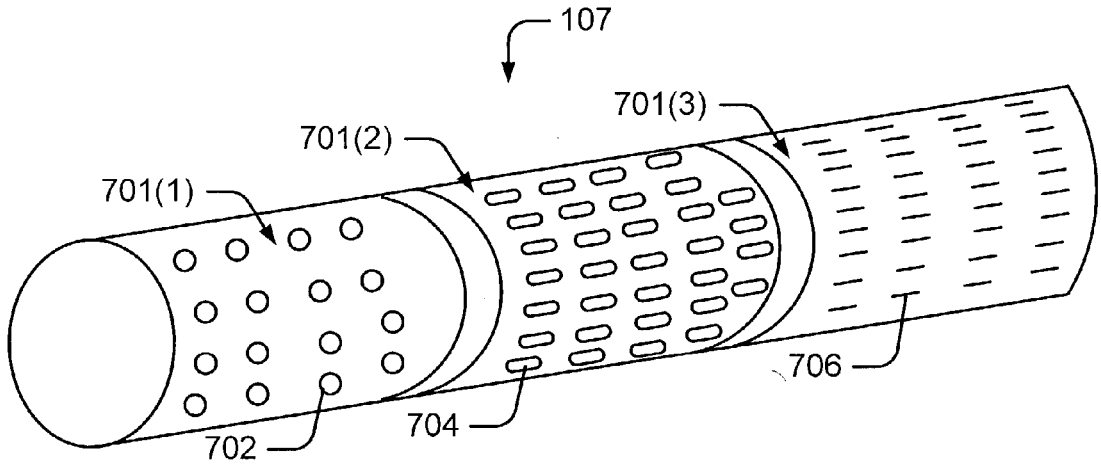
FIG. 7 is a perspective view of a center conductor illustrating three other types of patterns that may be distributed on a conductive surface including: spherical indentations, dash indentations, and straight knurl indentations.

FIG. 7 is a three dimensional view of center conductor 107 illustrating three other types of patterns 701(1), 701(2), and 701(3) that may be distributed on conductive surface 110 including: spherical indentations 702, dash indentations 704, and straight knurl indentations 706. Each one of these patterns may be distributed singularly or in combination with one or more other patterns distributed on center conductor 107. In the exemplary illustration, each pattern is separated by a concentric indentation 502. It should be noted that patterns referred to generally as reference number 701 are considered to exhibit the least amount of resistance to the flow of current in center conductor 107.

Although some implementations of the various methods and arrangements of the present invention have been illustrated in the accompanying Drawings and described in the foregoing Detailed Description, it will be understood that the invention is not limited to the exemplary aspects disclosed, but is capable of numerous rearrangements, modifications and substitutions without departing from the spirit of the invention as set forth and defined by the following claims.

What is claimed is:

1. A coaxial cable transmission line comprising:

an outer conductor;

a center conductor having a conductive surface with a continuous recessed pattern on the conductive surface wherein the pattern runs continuously along the length of the conductor and defines a non-recessed conductive surface on the center conductor;

a polytetrafluoroethylene material in continuous, direct contact with the non-recessed conductive surface of the center conductor, said material separating the outer conductor from the center conductor; and, wherein the continuous recessed pattern is configured to prevent the material from moving in an axial direction when the transmission line is exposed to repetitive and extreme temperature fluctuations.

2. The transmission line as recited in claim 1, wherein the transmission line is for use in aerospace applications.

3. The transmission line as recited in claim 1, wherein the extreme temperature fluctuation includes temperature variations ranging from above 200 degrees Fahrenheit to below negative 20 degrees Fahrenheit.

4. The transmission line as recited in claim 1, wherein center conductor comprises silver-plated copper.

5. The transmission line as recited in claim 1, wherein the conductive surface is silver.

6. The transmission line as recited in claim 1, wherein the continuous pattern forms indentations within the conductive surface.

7. The transmission line as recited in claim 1, wherein the continuous pattern includes at least one of the following patterns: helical indentations, helical knurl indentations, and diamond knurl indentations.

8. The transmission line as recited in claim 1, wherein at least one more additional pattern is combined with the continuous pattern, the additional pattern selected from the group consisting of: helical indentations, concentric indentations, helical knurl indentations, diamond knurl indentations, spherical indentations, dash indentations, and straight knurl indentations.

9. A coaxial cable, for aerospace applications, comprising:

an outer conductor;

a center conductor having a conductive surface with a continuous recessed pattern distributed on the conductive surface wherein the pattern runs continuously along the length of the conductor, the continuous pattern comprising indentations that are approximately between 0.001 and 0.004 of an inch deep, the continuous pattern defining a non-recessed conductive surface on the center conductor;

one or more layers of polytetrafluoroethylene (PTFE) tape encasing the center conductor, wherein the non-recessed conductive surface of the center conductor is in continuous, direct contact with one of said layers; said PTFE tape separating the outer conductor from the center conductor; and, wherein the continuous recessed pattern provides a coefficient of friction between the one or more layers of PTFE tape and the conductive surface great enough to prevent the one or more layers of PTFE tape from moving in an axial direction when the transmission line is exposed to an extreme temperature fluctuation.

10. The coaxial cable as recited in claim 9, wherein the extreme temperature fluctuation includes temperature variations ranging from below negative 20 degrees Fahrenheit to over 200 degree Fahrenheit.

11. The coaxial cable as recited in claim 9, wherein the conductive surface is silver.

12. The coaxial cable as recited in claim 9, wherein the continuous pattern comprises helical indentations.

13. The coaxial cable as recited in claim 9, wherein the continuous pattern comprises helical knurl indentations.

14. The coaxial cable as recited in claim 9, wherein the continuous pattern comprises diamond knurl indentations.

15. A coaxial cable, comprising:

an outer conductor;

a center conductor comprising a silver-plated conductive surface with a continuous recessed pattern distributed thereon, the continuous pattern extending continuously along the length of the conductor and comprising indentations that are approximately between 0.001 and 0.004 inches deep, the continuous pattern defining a non-recessed conductive surface on the center conductor;

one or more layers of polytetrafluoroethylene (PTFE) tape separating the outer conductor from the center conductor, wherein the non-recessed conductive surface of the center conductor is in continuous, direct contact with one of said layers; and, wherein the continuous recessed pattern is configured to prevent the one or more layers of PTFE tape from moving in an axial direction when the coaxial cable is exposed to repetitive and extreme temperature fluctuations.

16. The coaxial cable as recited in claim 15, wherein the extreme temperature fluctuations range from below negative 20 degrees Fahrenheit to over 200 degrees Fahrenheit.

17. The coaxial cable as recited in claim 15, wherein the continuous pattern comprises helical indentations.

18. The coaxial cable as recited in claim 15, wherein the continuous pattern comprises helical knurl indentations.

19. The coaxial cable as recited in claim 15, wherein the continuous pattern comprises diamond knurl indentations.

20. The coaxial cable as recited in claim 15, wherein at lease one more additional pattern is combined with the continuous pattern, the additional pattern selected from the group consisting of: helical indentations, concentric indentations, helical knurl indentations, diamond knurl indentations, spherical indentations, dash indentations, and straight knurl indentations.

* * * * *